United States Patent [19]

Mazur

[11] 4,417,636

[45] Nov. 29, 1983

[54] COOLING FAN DUCTING

[75] Inventor: Joseph S. Mazur, Livonia, Mich.

[73] Assignee: Eaton Corporation, Cleveland, Ohio

[21] Appl. No.: 276,109

[22] Filed: Jun. 22, 1981

[51] Int. Cl.[3] ..... B60H 1/24

[52] U.S. Cl. ..... 180/68 R; 165/122; 180/54 A; 474/12; 474/113; 474/114

[58] Field of Search ..... 180/54 A, 68 R, 54 R, 180/299, 291; 416/187, 178; 60/337, DIG. 5; 123/41.63, 41.65 A, 41.7, 41.49; 417/362, 423 R; 474/12, 113, 109, 114; 165/41, 44, 67, 122, 149; 98/207, 216; 237/12.3 A, 12.3 B, 12.3 R

[56] References Cited

U.S. PATENT DOCUMENTS

| | | | |
|---|---|---|---|
| 2,204,926 | 6/1940 | Clingerman | 180/54 A |
| 2,511,549 | 6/1950 | Simi | 180/54 A |
| 2,644,541 | 7/1953 | Bachle | 180/54 A |
| 2,680,490 | 6/1954 | Da Foe | 180/54 A |
| 3,236,215 | 2/1966 | Eck et al. | 237/12.3 A |
| 3,302,881 | 2/1967 | Laing et al. | 237/12.3 A |
| 3,613,645 | 10/1971 | Froumajou et al. | 180/54 R X |
| 3,618,691 | 11/1971 | Honda | 180/54 A |
| 3,630,003 | 12/1971 | Ashton et al. | 180/68 R X |
| 3,669,203 | 6/1972 | Honda | 180/54 A |
| 3,696,730 | 10/1972 | Masuda et al. | 180/54 A X |
| 3,856,100 | 12/1974 | Manning | 180/54 A |
| 3,915,024 | 10/1975 | Mort | 180/68 R X |
| 3,918,547 | 11/1975 | Kramer et al. | 180/54 A |
| 4,007,999 | 2/1977 | Serizawa | 416/187 X |
| 4,175,388 | 11/1979 | Milbreath et al. | 60/337 |

FOREIGN PATENT DOCUMENTS

| | | | |
|---|---|---|---|
| 885222 | 12/1961 | United Kingdom | 123/41.65 |
| 749701 | 7/1980 | U.S.S.R. | 180/68 R |

*Primary Examiner*—Joseph F. Peters, Jr.
*Assistant Examiner*—Mitchell J. Hill
*Attorney, Agent, or Firm*—C. H. Grace; P. S. Rulon

[57] ABSTRACT

Disclosed is a vehicle having a liquid-cooled engine (20) transversely mounted for rocking motion relative to the vehicle frame (42); an engine cooling radiator (22) mounted forwardly of the engine and substantially parallel to the rotation axis of the engine crankshaft; a cross-flow fan (24) having a rotational axis substantially parallel to the crankshaft axis and disposed between the crankshaft axis and the plane of the radiator; the fan is engine driven by a belt (36), and a viscous coupling (29) to vary the fan speed in response to engine cooling requirements. In one embodiment the engine moves relative to the fan and the radiator. In this embodiment an air inlet duct assembly (40) is defined by a portion (26a) of the engine and members extending from the radiator to the engine. In the other embodiment the fan is fixed for movement with the engine and an air inlet duct assembly (126) allows movement between the fan and the radiator.

11 Claims, 7 Drawing Figures

FIG. 1.
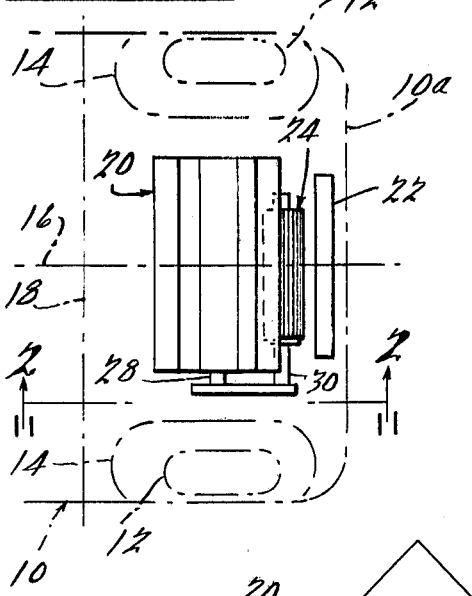
FIG. 2.
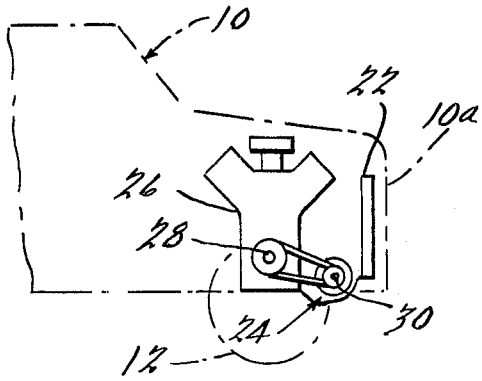
FIG. 3.
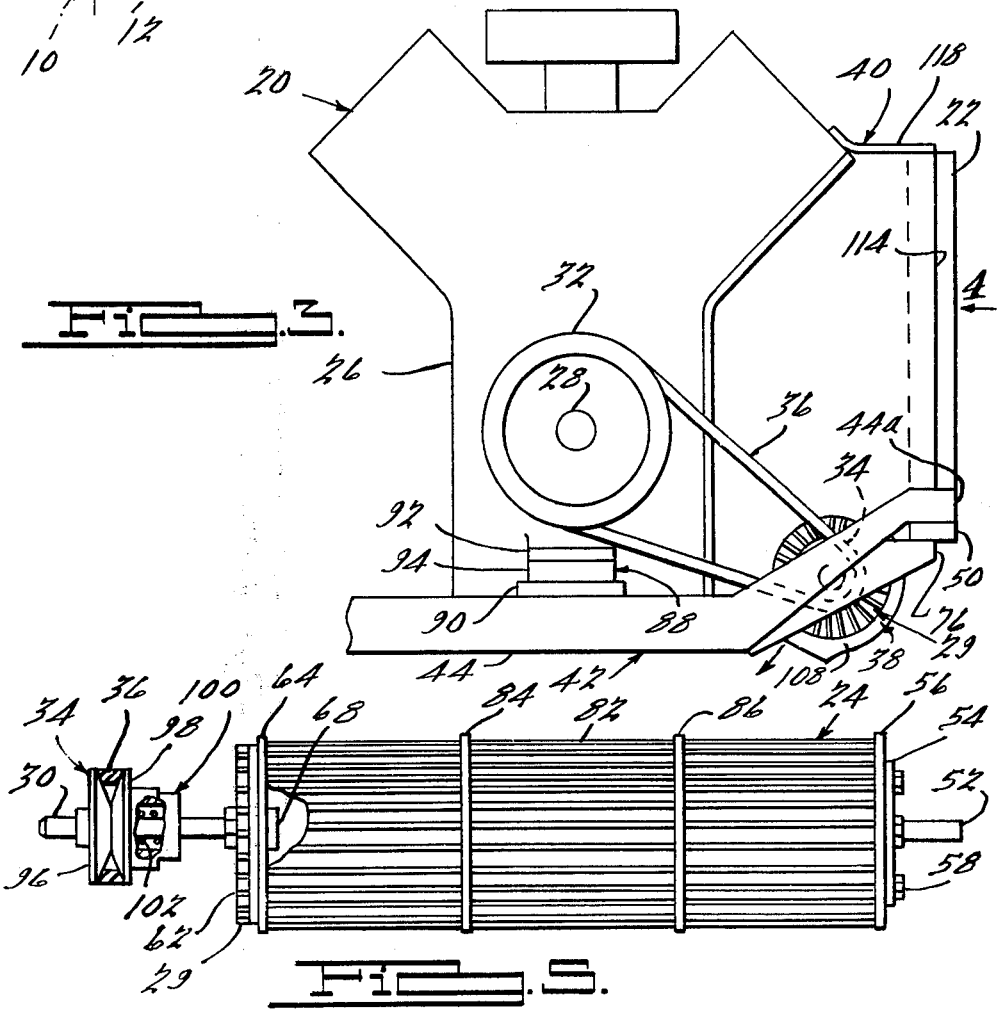
FIG. 5.

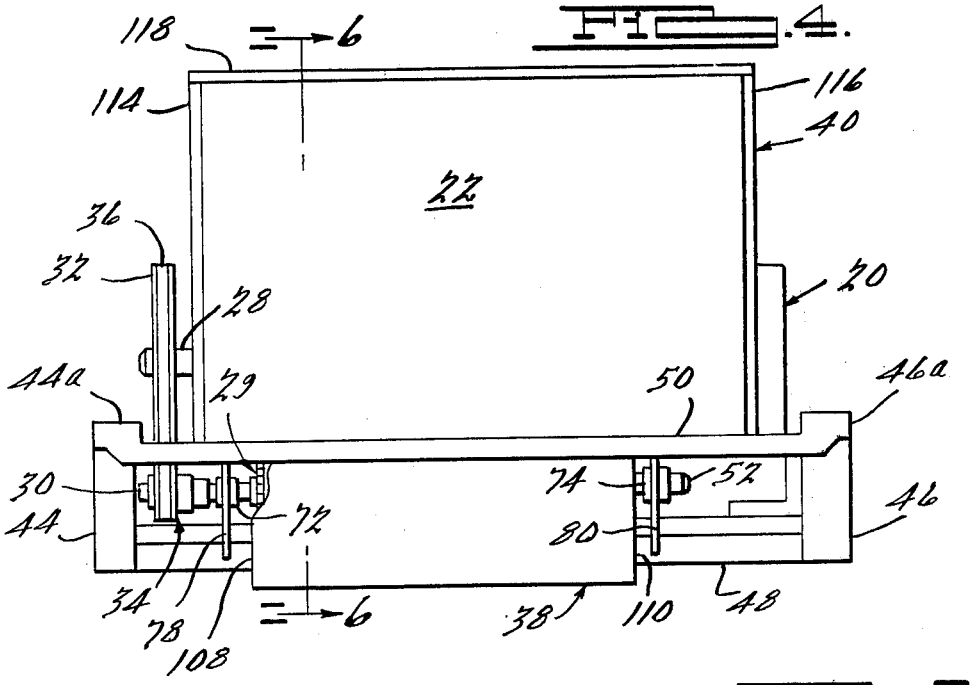
FIG. 4.
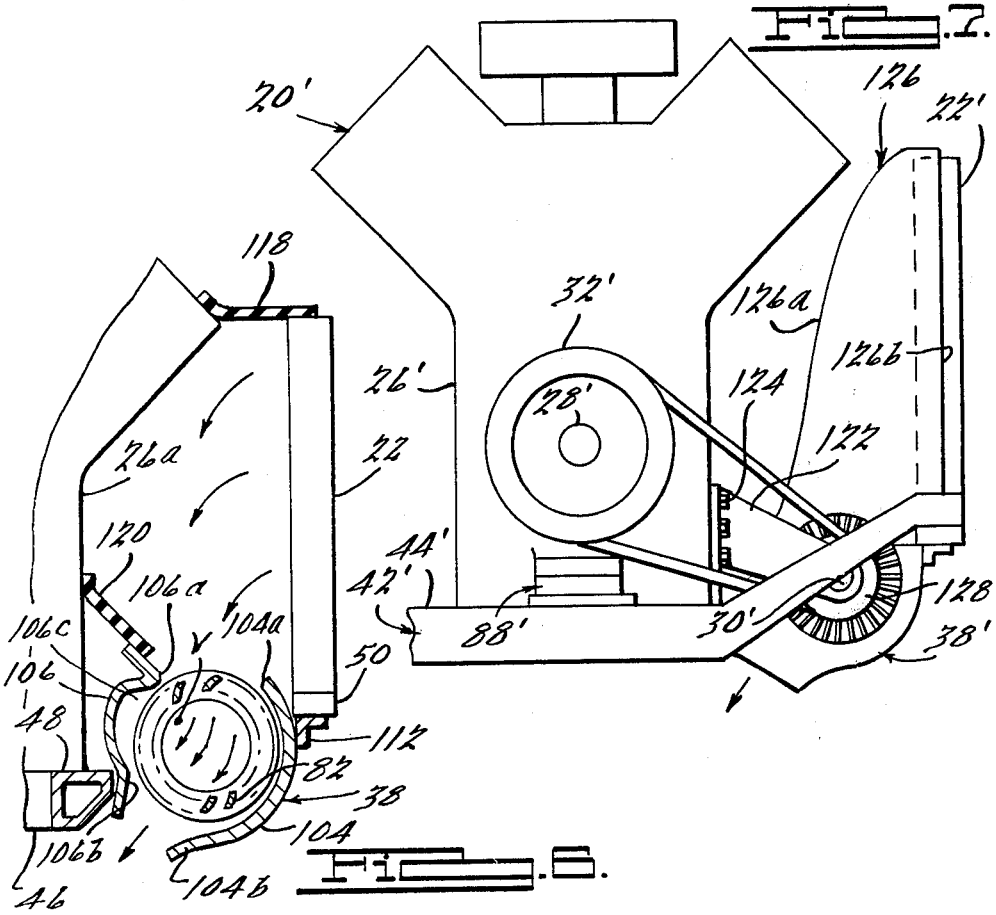
FIG. 5.
FIG. 6.

COOLING FAN DUCTING

CROSS-REFERENCE TO RELATED APPLICATIONS

This application is related to U.S. Pat. Nos. 4,372,409 issued Feb. 8, 1983 and 4,376,424 issued Mar. 15, 1983, and U.S. Patent application Ser. No. 183,890, filed Sept. 4, 1980. All of these applications are assigned to the assignee of this application and all are incorporated herein by reference.

FIELD OF THE INVENTION

This invention relates to vehicle engine cooling and, in particular, to a duct assembly and mounting arrangement for a cooling fan.

BACKGROUND OF THE INVENTION

The current proliferation of front wheel drive vehicles with liquid-cooled engines mounted transverse to the longitudinal axis of the vehicle has complicated traditional cooling fan drive arrangements wherein the engine is mounted parallel to the longitudinal axis. Vehicles with either longitudinally or transversely mounted engines preferably have the radiator positioned forwardly of the engine and in a plane transverse to the longitudinal axis since such positioning provides direct access for ambient air flow through the radiator, particularly ram air, and since space for the radiator is readily provided with such positioning.

In vehicles with longitudinally mounted engines, forwardly mounted radiators, and axial flow fans mounted therebetween, the axial flow fans are conveniently mounted on the front of the engines with the rotational axes of the fans positioned parallel to the engine crankshaft axes and the fans are readily driven by mechanical drives such as belts driven by pulleys mounted on forward projections of the engine crankshafts. Such drive arrangements are simple, reliable, relatively inexpensive, and last, but not least, relatively efficient. In vehicles with radiators mounted forward of the engines and parallel to the rotational axes of the engine crankshafts (as is the case with transverse engine vehicles), axial flow fans cannot be readily mounted on the engines with the rotational axes of the fans parallel to the crankshaft axes and cannot be readily driven by mechanical drive arrangements such as belts driven by pulleys mounted on projections of the engine crankshafts, since the necessary space for such arrangements is not available. Hence, vehicles with transversely mounted engines and radiators mounted forward of the engines and parallel to the axes of the engine crankshafts, for the most part, now use electric motors to drive the fans. The electric motors are in general more expense than mechanical drive arrangements and are believed to be less reliable. Further, since the electric motors are price sensitive per unit horsepower and are substantially less efficient than mechanical drives, some vehicle manufacturers have increased the size of the radiators to reduce motor size and have spent considerable time developing more efficient fans to further reduce motor size.

One prior art reference, U.S. Pat. No. 3,696,730 issued Oct. 10, 1972, schematically discloses a transverse engine vehicle with a forwardly mounted radiator and several embodiments of mechanically driven fans. One of the embodiments discloses a centrifugal fan with axial inlet and radial outlet mounted on one end of the engine. The other embodiments disclose axial flow fans transversely disposed with respect to one end of the engine and with the rotational axes of the fans either in line with the engine crankshaft axis or forward thereof. All of these embodiments require transverse offsetting of the radiators and/or the engines, transverse offsetting of the fans, bulky ducts for directing air to and from the fans, and tortuous flow paths for the air. Transverse offsetting of the radiators though possible even in relatively small cars is not desirable since it interferes with headlight and fender mounting unless the front of the vehicle is extended to provide additional room. Transverse offsetting of transversely mounted engines is undesirable since it upsets vehicle weight distribution and as a practical matter, there is insufficient transverse space for such offsetting in passenger vehicles with forwardly mounted transverse engines. Likewise, there is insufficient transverse space for transverse offsetting or positioning of the fans at one end of the engines. Further, the bulky or large ducts for directing the air to and from the fans would at best be difficult to install in the limited space available in such vehicles.

In addition, the cooling fan embodiments of the above mentioned patent do not provide means to vary the fan speed in accordance with engine cooling needs. In a present day vehicle with air-conditioning, a cooling fan having the pumping capacity to cool both the engine radiator and the air conditioner condenser has far more pumping capacity than is needed when the air conditioner is not in use or when the forward speed of the vehicle is great enough to provide cooling by ram air. Such excess fan capacity puts a substantial horsepower drain on already small engines and wastes energy.

SUMMARY OF THE INVENTION

An object of this invention is to provide duct assemblies for an engine driven cooling fan which may be engine or vehicle mounted.

Another object of this invention is to provide an engine mounted cooling fan.

According to a feature of the invention, a vehicle including a liquid-cooled engine having a housing and a crankshaft, a radiator disposed in a plane spaced from and substantially parallel to the rotational axis of the crankshaft, and a cross-flow fan mounted for rotation of the fan about an axis substantially parallel to the crankshaft axis is provided with a inlet air duct assembly defined by duct members extending from the radiator to the engine housing and with a duct member defined by a portion of the engine housing.

According to another feature of the invention, a vehicle including a liquid cooled engine having a crankshaft mounted therein for rotation about an axis, a radiator disposed in a plane spaced from and substantially parallel to the axis, and cross-flow fan is provided with means mounting the fan on the engine for rotation of the fan about an axis substantially parallel to the crankshaft axis.

BRIEF DESCRIPTION OF THE DRAWINGS

The cross-flow fan assemblies and the air inlet duct assemblies of the instant invention are shown in the accompanying drawings in which:

FIG. 1 is a downwardly looking schematic of the general relationship between the vehicle body shown in partial outline, the engine, and the radiator relative to a cross-flow fan;

FIG. 2 is a vertical schematic of the general relationship looking along line 2—2 of FIG. 1;

FIG. 3 is an enlargement of a portion of FIG. 2, still in schematic form, but further showing one embodiment of a cross-flow fan mounting arrangement and duct assembly;

FIG. 4 is a vertical schematic looking in the direction of arrow 4—4 of FIG. 3;

FIG. 5 is an enlarged view of the cross-flow fan with a split pulley and a viscous coupling on the input drive to the fan;

FIG. 6 is a sectional portion of the embodiment of FIGS. 3-5 looking along line 6—6 of FIG. 4; and FIG. 7 is an enlargement of a portion of FIG. 2, still in schematic form, but now showing another embodiment of the cross-flow fan mounting arrangement and duct assembly.

Certain terminology referring to specific types of components, direction, motion, and the relationship of components to each other will be used in the following description. This terminology is for convenience in describing the invention and should not be considered limiting unless explicitly used in the claims.

DETAILED DESCRIPTION OF THE DRAWINGS

Looking first at the plan and elevational views of FIGS. 1 and 2, therein is shown a front portion of a vehicle with the vehicle body 10, front wheels 12, and inner fenders 14 shown in phantom lines. The vehicle grille or front 10*a* faces the direction of forward vehicle motion. Axis line 16 represents the longitudinal axis of the vehicle and axis line 18 represents the transverse axis of the vehicle. Within body 10 is a transversely mounted engine 20 of the liquid-cooled type, a radiator 22 mounted behind the grille and forward of the engine with the plane of the radiator substantially parallel to the transverse axis, and a cross-flow fan 24 mounted on the discharge or rear side of the radiator. The block outline representing radiator 22 may also include an air-conditioning condenser. Cross-flow fans, which are sometimes referred to as double traverse fans or tangential fans are species of centrifugal fans but differ from commonly known centrifugal fans in that they pump air radially inward and outward such that the air passes chordally across the circumferential extent of the fan, whereas commonly known centrifugal fans pump air radially inward and then axially outward or vice versa. For a given fan speed and pumping capacity cross-flow fans are generally smaller in diameter than commonly known centrifugal fans, whereby the cross-flow fans are more readily positioned in limited spaces. Further, since cross-flow fans pump air chordally across the circumferential extent of the fans, the fans and their inlet and outlet ducts may be positioned directly behind the radiators, whereby the packaging of cross-flow fans and their ducts may be made substantially more compact than the packaging of the commonly known centrifugal fans and their ducts. Engine 20, which may drive the front wheels and/or the rear wheels, includes a housing or block 26 having an unshown crankshaft mounted therein for rotation about an axis. A shaft 28, which projects from block 26, may be an extension of the crankshaft or a shaft driven by the crankshaft.

Looking now mainly at FIGS. 3-6, these figures are more detailed schematics of components shown in FIGS. 1 and 2 and show details of the first embodiment of the invention. Starting with FIGS. 3 and 4, cross-flow fan 24 is connected at its input with a viscous coupling 29 (best seen in FIG. 5) having an input shaft 30 driven by a mechanical drive assembly including a V-pulley 32 fixed to shaft 28, a split V-pulley 34 fixed to rotate with shaft 30, and a V-belt 36. Cross-flow fan 24 is part of a cross-flow fan assembly having a shrouded assembly 38 which receives cooling air from an air inlet duct assembly 40. Shroud and duct assemblies 38 and 40 are not shown in FIGS. 1 and 2 so that the position of the cross-flow fan with respect to the radiator and engine may be readily seen. Engine 20 and radiator 22 are conventionally mounted on a vehicle frame 42. Frame 42 includes two horizontally, longitudinally extending rails 44 and 46 and a transverse cross member 48. Forward of the engine, rails 44 and 46 taper down and are bent upward at about a 30° angle. The forward ends 44*a* and 46*a* of the rails provide support for a transverse cross member 50 which supports the radiator. The radiator may be shock or vibration insulated from frame 42 by conventional rubber mounts which are not shown. But for all practical purposes, the mounts fix the radiator against movement relative to the frame.

As may be seen in FIGS. 4 and 5, the rotational axis of cross-flow fan 24 is defined by input shaft 30 at the left end of the fan and a shaft 52 at the right end of the fan. Shaft 52 is fixed to an end plate 54 which is secured to an end ring 56 of the fan by a plurality of bolts 58. At the left end of the fan, viscous coupling 29 is interposed between the fan and the input shaft. Coupling 29, which may be substantially the same as the coupling disclosed in U.S. Pat. No. 4,051,936, includes a housing 62 secured to an end ring 64 of the fan by a plurality of unshown bolts, an unshown fluid working chamber defined by the housing and containing a viscous fluid, and an unshown drive or input member rotatably disposed in the working chamber and driven by input shaft 30. U.S. Pat. No. 4,051,936, issued Oct. 4, 1977, is incorporated herein by reference. However, many other types of viscous coupling may be used, e.g., the couplings disclosed in U.S. Pat. No. 4,056,178 issued Nov. 1, 1977, or U.S. Pat. No. 3,972,399, issued Aug. 3, 1976. Housing 62 is rotated by viscous shear forces in response to rotation of input shaft 30. The shear forces determine the torque transmitting capacity of the coupling and therefore the rotational speed diferences between input shaft 30 and housing 62. To control the torque transmitting capacity, coupling 29 includes an unshown pump in the working chamber for pumping the viscous fluid out of the chamber to a reservoir, an unshown valve which controls fluid to and from the reservoir, and a bimetalic spring 68 mounted on an outer portion of housing 62 which faces the interior of fan 24. Spring 68 responds to the temperature of the air flowing across the interior of the fan. When the air temperature is above a predetermined amount and a maximum torque capacity is needed, spring 68 moves the unshown valve to a position restricting fluid flow from the working chamber to the reservoir and allowing fluid flow from the reservoir to the working chamber. When the air temperature is below a predetermined amount and a minimum torque capacity is needed, spring 68 moves the unshown valve to a position allowing fluid flow from the working chamber to the reservoir and restricting fluid flow from the reservoir to the working chamber. For intermediate air temperatures, spring 68 modulates the valve position to control the torque of the coupling at required amounts between the maximum and minimum.

Shafts 30 and 52 are journaled in bearings 72 and 74, carried by support members 78 and 80. Members 78 and 80 are fixed to cross members 48 and 50. Collctively, the members fix the rotational axis of the fan relative to the frame with the fan axis substantially parallel to the rotational axis of the engine crankshaft and behind the plane of the radiator.

The outer circumferential extent of the fan is defined by a plurality of forwardly leaning blades 82 (herein twenty-three blades) which are circumferentially arrayed about the rotational axis of the fan. The forward leaning of blades 82 is most clearly shown in FIG. 6. The blades are supported at their ends by the end rings 56 and 64 and are supported therebetween by intermediate rings 84 and 86 with the axial extent of the blades parallel to the rotational axis and with the radial extent of the blades extending generally inward toward the rotational axis. The axial extent of blades 82 preferably, but not necessarily, extend the full or (as herein) substantially the full width of the radiator, thereby providing a direct and low resistance air flow path from the radiator to the fan. As may be seen in FIG. 4, fan 24 is positioned somewhat offset with respect to the vertical center of the radiator. This offset positioning was done to minimize the length of input shaft 30 of the test fan. The test was conducted in a front wheel drive vehicle having a transversely mounted V-6 engine and a radiator about twenty-four inches wide. The test fan was about eighteen inches long and about six inches in diameter. Fan 24 may extend the full width of the radiator, may extend less than the full width and be centered, or comprise a plurality of such fans. When a plurality of fans are used, they may be axially aligned and/or vertically stacked with respect to each other. A single fan of the same capacity as fan 24 may be made by increasing the fan length and reducing the fan diameter.

Looking again at FIG. 3, engine 20 is conventionally mounted on frame 42 via mounts which allow the engine to rock or move in a direction transverse to the crankshaft axis in response to varying engine load, such rocking or transverse movement being reaction torque on the crankshaft. Only one engine mount 88 is shown. The mount includes metal plates 90 and 92 fixed respectively to rail 44 and block or housing 26 and a rubber pad 94 bonded to the plates. Engine 20 rocks counterclockwise with respect to mount 88 in response to increasing load, thereby increasing the center distance between shafts 28 and 30 with increasing engine load.

Looking now at FIGS. 4 and 5, and in particular at FIG. 5, split pulley 34 includes pulley halves 96 and 98 and a tensioning means 100. Pulley half 96 is fixed against rotation and axial movement relative to shaft 30. Pulley half 98 is fixed against rotation relative to shaft 30 but is free to slide axially. Tensioning means 100 includes a helical spring 102 partially shown in a broken-away portion of a protective cover. Spring 102 biases pulley half 98 toward half 96, thereby resiliently reducing the width of the V-groove defined by the two halves. When the width of the V-groove is a minimum, pulley 34 presents a maximum diameter to V-belt 36. When engine 20 rocks counterclockwise and changes the center distance between shafts 28 and 30, the tension on V-belt 36 tends to increase. Hence, pulley half 98 moves axially against spring 102 to widen the V-groove and allows the V-belt to move deeper into the groove, whereby pulley 34 presents a reduced diameter to the V-belt to maintain a relatively constant tension on the V-belt. The change in the diameter presented to the V-belt by pulley 34 also changes the speed ratio between shaft 28 and 30. Hence, in the embodiment FIGS. 3–6, with pulley 34 mounted on input shaft 30 the rotational speed of fan 24 will increase with increasing engine load. By mounting pulley 34 on shaft 28 the fan speed will decrease with engine load.

Looking now mainly at FIG. 6, shroud assembly 38 may be formed of sheet metal or plastic materials. The assembly includes shroud members 104 and 106 extending the full axial length of the fan blades and joined together at their ends by end plates 108 and 110. Member 104 is fixed and sealed to cross member 50 by an elongated bracket 112, includes a portion **104*a* closely spaced radially outward of the fan blades at about the two o'clock position of the fan, and includes an involute portion 104*b* extending from portion 104*a* to about the seven o'clock position of the fan. Shroud member 106 includes portions 106*a* and 106*b* closely spaced radially outward of the fan blades at about the eleven and nine o'clock positions repectively, and a pocket 106*c* between the portions to control a vortex associated with air flow through the fan blades. Portions 104*a* and 106*a* define the circumferential boundaries forming the fan inlet and portions 104*b* and 106*b*** define the circumferential boundaries forming the fan outlet.

Air inlet duct assembly 40 is defined by members 114, 116, and 118 extending from the radiator sides and top to the engine, a wall portion **26*a* of the engine block or housing 26, and a member 120 extending from shroud portion 106*a* to housing 26. Members 114, 116, 118, and 120 may be formed of flexible material such as rubber or plastic to allow movement of the engine relative to the radiator; or the members may be formed of a more rigid material and with one end fixed to the engine housing or the radiator and the other end in slideable, sealing contact with the housing or radiator. Further, the members may be formed with accordion like pleats to provide the necessary flexing. Member 120 may be dispensed with by merely sealing the space between shroud member 106 and transverse cross member 48. Members 114, 116, and 118, and 120** may be provided with spring loaded louvers, not shown, to allow increased air flow through the radiator when the vehicle is moving.

Duct assembly 40 has several advantages over the duct assemblies shown in the previously mentioned applications. These advantages include maximizing of the air flow area between the radiator discharge and the fan inlet, simplifying installation of the members forming the ducts, and improved cooling of engine parts and accessories disposed in the space between the engine housing and radiator. While the space between the housing and the radiator looks relatively large in the schematics herein, the space is in fact relatively cluttered with parts and accessories. For example, one currently produced transverse engine vehicle with a V-6 engine such as shown herein has the exhaust manifold for the front three engine cylinders and the engine fuel pump in this space. Duct assembly 40 not only avoids entanglement with the manifold and pump but also provides direct cooling thereto as well as direct cooling to the engine housing defining a portion of the duct assembly.

Looking now at the air flow through fan 24, a recirculation or back flow of air already transmitted to the inside of the fan or impeller is caused by an unavoidable internal vortex within the fan. The vortex is generally centered at a radial point traversed by the inner edges of the fan blades. The recirculating air or vortex size is responsible for energy losses which can be considerable. Fan efficiency, which is proportional to the total volume of the recirculating air, can be controlled by controlling the size of the vortex. The vortex within fan 24 is generally centered at about a point V and is controlled by pocket 106*c*. Several other means for controlling the vortex are known and can be found in Fans, Dr. -Ing. Bruno Eck, 1973 Vieweg & Sohn GmbH, Burgplatz 1, Braunschweig, which is incorporated herein by reference. Looking now at the air flow arrows in FIG. 6, in general, the air flows in hook curved paths in vertically extending planes which are generally parallel to the longitudinal axis of the vehicle. Air passes through the core of the radiator 22, which defines the duct assembly inlet, to the inlet area of the fan where it is impelled radially inward by the blades 82 and chordally across the interior of the fan where it is then impelled radially outward by the blades to the discharge area. As may be seen, the radius of curvature of the air within the fan decreases in proportion to its proximity to the vortex center V. A portion of this air passes into the pocket 106*c* and back to the inlet area due to the curvature of the pocket walls. By merely changing the shroud outlet configuration the outlet air may be directed elsewhere, e.g., the air may be directed upward around the sides and bottom of the engine. The remainder of the air flows downward and rearward under the vehicle.

In the embodiment of FIG. 7, components which are substantially the same as components in the previously described figures are given the same reference numbers with the addition of a prime. Accordingly, engine 20' is mounted for rocking motion relative to frame 42' and radiator 22' is fixed to the frame. However, the cross-flow fan assembly is now fixed to the engine housing by a pair of brackets 122 disposed at opposite ends of the assembly in lieu of support members 78 and 80. Only one of the brackets is shown. The brackets are fixed at one end to housing 26' by a plurality of bolts 124; at the other end the brackets rotationally support fan 24' for rotation about an axis substantially parallel to and spaced from the crankshaft axis as in the first embodiment. However, the fan axis is now fixed against transverse movement relative to the engine and crankshaft in response movement of housing 26' on mounts 88'. Since there is no relative movement between shafts 28' and 30', split pulley 34 is replaced by a fixed diameter pulley 128.

A duct assembly for directing cooling air from radiator 22' to the fan assembly may be substantially the same as air inlet duct assembly 40 in FIGS. 3–6 or may be like duct assembly 126 in FIG. 7. Duct assembly 126 includes a back portion 126*a* and side portions disposed at either end thereof, one side portion 126*b* is shown. The duct portions are fixed at their ends adjacent shroud assembly 38' and are slidable relative to the radiator at their ends adjacent the radiator, thereby allowing movement of the fan assembly relative to the radiator in response to engine movement. As an alternative, duct assembly 126 is made flexible some place between radiator 22' and shroud assembly 38', in which case the duct assembly may be fixed to the radiator and shroud for improved sealing. To provide flexing the shroud material may be formed of flexible rubber or plastic or formed with accordion pleats.

Two embodiments of the invention have been disclosed for illustrative purposes. Many variations and modifications of the disclosed embodiments are believed to be within the spirit of the invention. To mention but a few, viscous coupling 29 may be replaced by an electromagnetic clutch such as disclosed in U.S. Pat. No. 4,376,424 issued Mar. 15, 1983, the split pulley may be mounted on shaft 28, split pulleys may be mounted on both shafts 28 and 30, and/or the V-belt of FIG. 7 may be replaced by gears or a cog belt or a serpentine belt. The following claims are intended to cover the inventive portions of the invention and variations and modifications within the spirit of the disclosed invention.

What is claimed is:

1. In a vehicle of the type including a liquid-cooled engine having a housing and a crankshaft mounted therein for rotation about an axis, a radiator disposed in a plane substantially parallel to the axis and spaced from the housing for cooling the liquid by air directed therethrough, a cross-flow fan assembly for pulling air through the radiator toward the engine housing, the improvement comprising:

an air inlet duct assembly for directing the cooling air to the cross-flow fan inlet, said duct assembly having an inlet defined by the radiator, by members extending from the radiator to the engine housing, and additionally by a portion of the engine housing.

2. In a vehicle of the type including a liquid-cooled engine having a housing and a crankshaft mounted therein for rotation about an axis; means forwardly mounting the engine with the crankshaft axis transverse to the longitudinal axis of the vehicle; a radiator for cooling the liquid by air directed therethrough, the radiator being disposed in a plane substantially parallel to the crankshaft axis, spaced from the housing, and forward of the housing; a cross-flow fan assembly pulling air through the radiator toward the engine housing; the improvement comprising:

an air inlet duct assembly for directing the cooling air to the cross-flow fan inlet, said duct assembly having an inlet defined by the radiator, by members extending from the radiator to the engine housing, and additionally by a portion of the engine housing.

3. The vehicle of claim 1 or 2, wherein the cross-flow fan assembly includes:

means mounting the fan for rotation about an axis spaced from and parallel to the crankshaft axis.

4. The vehicle of claim 1 or 2, further including a vehicle frame means mounting the engine on the frame for movement of the engine and crankshaft relative to the frame in a direction transverse to the crankshaft axis, and wherein the cross-flow fan assembly includes:

means mounting the fan assembly on the frame for rotation of the fan about an axis spaced a variable distance from and substantially parallel to the crankshaft axis.

5. The vehicle of claim 1 or 2, further including a vehicle frame;

means mounting the engine on the frame for movement of the engine and crankshaft relative to the frame in a direction transverse to the crankshaft axis and relative to the plane of the radiator and wherein the cross-flow fan assembly includes:

means mounting the fan assembly on the housing for rotation of the fan about an axis spaced a fixed distance from and substantially parallel to the crankshaft axis.

6. The vehicle of claim 1 or 2, wherein the engine is mounted for movement in a direction transverse to the crankshaft axis and transverse to the plane of the radiator, and wherein said duct portion defined by members extending from the radiator to the housing comprising:

flexible members for allowing movement of the engine relative to the radiator.

7. In a vehicle of the type including a frame; a liquid-cooled engine having a housing and a crankshaft mounted therein for rotation about an axis; means mounting the engine housing on the frame for movement of the housing and crankshaft relative to the frame in a direction transverse to the crankshaft axis; a radiator for cooling the liquid by air directed therethrough, the radiator being disposed in a plane substantially parallel to the axis, spaced from the housing, and substantially nonmoveable relative to the frame; a cross-flow fan assembly for pulling air through the radiator toward the housing; the improvement comprising:

means mounting the fan assembly on the housing directly between the radiator and the engine housing for rotation of the fan about an axis spaced a fixed distance from and substantially parallel to the crankshaft axis.

8. In a vehicle of the type including a frame; a liquid-cooled engine having a housing and a crankshaft mounted therein for rotation about an axis; means forwardly mounting the engine housing on the frame with the crankshaft axis transverse to the longitudinal axis of the vehicle and for movement of the housing and crankshaft relative to the frame in a direction transverse to the crankshaft axis; a radiator for cooling the liquid by air directed therethrough, the radiator being disposed in a plane substantially parallel to the axis, spaced forward of the housing, and substantially nonmoveable relative to the frame; a cross-flow fan assembly for pulling air through the radiator toward the housing; the improvement comprising:

means mounting the fan assembly on the housing directly behind radiator and in front of the engine housing for rotation of the fan about an axis spaced a fixed distance from and substantially parallel to the crankshaft axis.

9. The vehicle of claim 7 or 8, further including:

a shroud assembly embracing the outer circumferential extent of the fan and defining substantially diametrically opposed cross-flow fan inlet and outlet openings for directing the air across the fan; and an air inlet duct assembly for directing the cooling air from the radiator to the cross-flow fan inlet and allowing movement of the fan assembly relative to the radiator.

10. In a vehicle of the type including a liquid-cooled engine having a housing and a crankshaft mounted therein for rotation about an axis, a radiator disposed in a plane substantially parallel to the axis and spaced from the housing for cooling the liquid by air directed therethrough, a fan assembly for pulling air through the radiator toward the engine housing, the improvement comprising:

an air inlet duct assembly for directing the cooling air to the fan inlet, said duct assembly having an inlet defined by the radiator, by members extending from the radiator to the engine housing, and additionally by a portion of the engine housing.

11. In a vehicle of the type including a liquid-cooled engine having a housing and a crankshaft mounted therein for rotation about an axis; means forwardly mounting the engine with the crankshaft axis transverse to the longitudinal axis of the vehicle; a radiator for cooling the liquid by air directed therethrough, the radiator being disposed in a plane substantially parallel to the crankshaft axis, spaced from the housing, and forward of the housing; a fan assembly pulling air through the radiator toward the engine housing; the improvement comprising:

an air inlet duct assembly for directing the cooling air to the fan inlet, said duct assembly having an inlet defined by the radiator, by members extending from the radiator to the engine housing, and additionally by a portion of the engine housing.

* * * * *